US006022071A

United States Patent [19]

Smith

[11] Patent Number: 6,022,071

[45] **Date of Patent: *Feb. 8, 2000**

[54] RECLINING CHAIR

[76] Inventor: Nathaniel L. Smith, 46 Front St., Holliston, Mass. 01746

[ * ] Notice: This patent is subject to a terminal disclaimer.

[21] Appl. No.: 09/054,762

[22] Filed: Apr. 3, 1998

Related U.S. Application Data

[63] Continuation of application No. 08/662,777, Jun. 10, 1996.

[51] Int. Cl.[7] ..... A47C 1/02

[52] U.S. Cl. ..... 297/88; 297/452.4; 297/271.1; 297/270.4

[58] Field of Search ..... 297/258.1, 270.1, 297/270.2, 270.3, 271.1, 271.3, 271.4, 88–89, DIG. 7, 452.18, 68, 452.4, 270.4

[56] References Cited

U.S. PATENT DOCUMENTS 3,081,128 3/1963 Schliephacke .
3,747,973 7/1973 Re .
4,437,701 3/1984 Mizelle .
4,477,118 10/1984 Ruble .
4,779,921 10/1988 Holmstrom .
5,294,177 3/1994 Rasnick et al. .

*Primary Examiner*—Milton Nelson, Jr.
*Attorney, Agent, or Firm*—Wolf, Greenfield & Sacks, P.C.

[57] ABSTRACT

A swivel type chair that functions as both a high back desk chair and a recliner. The seat and backrest pivot as a unit on the base between upright and reclined positions and a footrest is movable pivotally with respect to the seat and is tucked underneath the seat when the chair is in the upright position to function as a desk chair and elevates to an extended position automatically when the chair is moved to the reclined position. A brake mechanism is carried on the chair for locking the seat and backrest in any selected position between the upright and reclined positions.

22 Claims, 9 Drawing Sheets

RECLINING CHAIR

PRIOR RELATED APPLICATION

This application is a continuation of copending application Ser. No. 08/662,777 filed Jun. 10, 1996.

INTRODUCTION

This invention relates to reclining chairs and more particularly comprises a new and improved recliner which functions effectively as an executive high-back desk chair with a swivel base.

Conventional recliner type-chairs cannot function comfortably as desk chairs because they lack several features required to serve that purpose. For example, recliner chairs conventionally have footrests that do not allow the chair occupant to place his/her feet flat on the floor below the seat when the chair is in the upright position. The footrest in a conventional recliner extends vertically downward from the front edge of the seat, and the chair occupant cannot bring his/her feet rearwardly beneath the seat into a normal resting position. Furthermore, the recliners presently available do not have a swivel-type base with casters but rather are supported on a fixed base which cannot roll about on the floor to enable the occupant to position him/her self close to the working surface of a desk or table. On the other hand, executive high-back chairs do not include footrests, and the back and seat, although tiltable on the base provide no comfortable support for the occupant's legs and cannot be locked in an intermediate position.

The chair of the present invention includes many important ergonomic features of an executive high-back chair, but in addition provides a very comfortable stress free, reclining position for the occupant. As a result, the chair of the present invention may be used in many different positions either in the home or office. That is, the chair provides ergonomical support for the occupant when in the upright position so that it may be used comfortably at a desk, and it may be placed in a semi-reclined position for a relaxed phone conversation or reading, and the chair may also be placed in a fully reclined position for an invigorating break whenever desired.

In accordance with the preferred embodiment of the invention, the chair has a swivel-type, pedestal base including a frame which pivotally carries a body support assembly including a back, seat and footrest. The back and seat are in fixed angular relationship with one another while the footrest is pivotally connected to the front of the seat so that its angular position may be changed with respect to the seat. The body support assembly may be locked by the occupant in any selected position between an upright and fully reclined position simply by activating brake mechanisms which are conveniently positioned on each side of the body support. A linkage mechanism is mounted beneath the seat and connected to both the base and footrest, which automatically elevates the footrest from an inactive position wherein the footrest is tucked underneath the seat so as not to interfere with the chair occupant when the chair is in the upright position, to an elevated position wherein the footrest is disposed substantially horizontally when the chair is in the fully reclined position so as to support the occupant's legs at a height above the heart to promote circulation.

These and other objects and features of the present invention will be better understood and appreciated from the following detailed description of the preferred embodiment thereof, read in connection with the accompanying drawings.

BRIEF FIGURE DESCRIPTION

Figure 1:
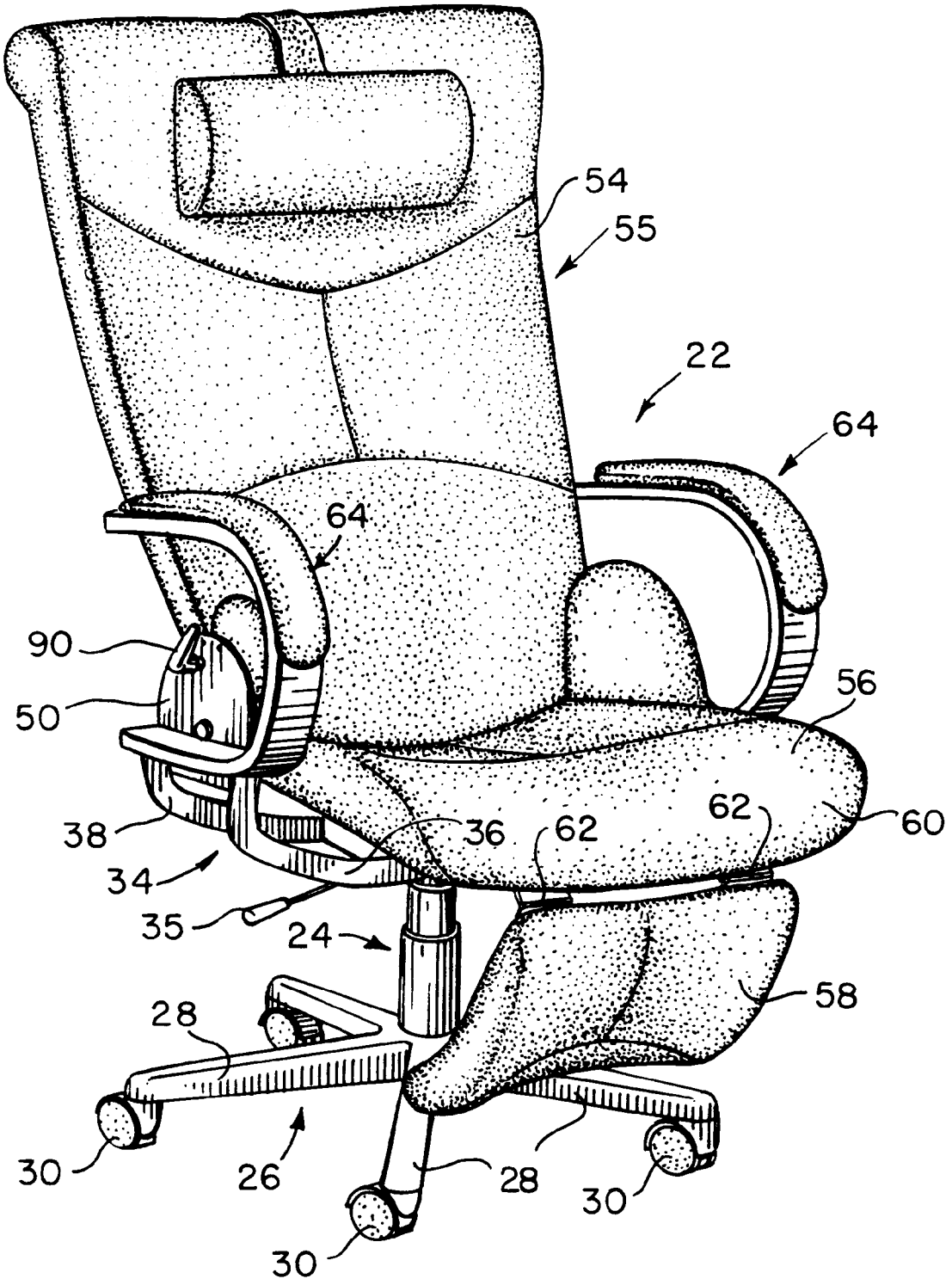
FIG. 1 is a perspective view of a preferred embodiment of a reclining chair constructed in accordance with the present invention and shown in the upright position.
Figure 2:
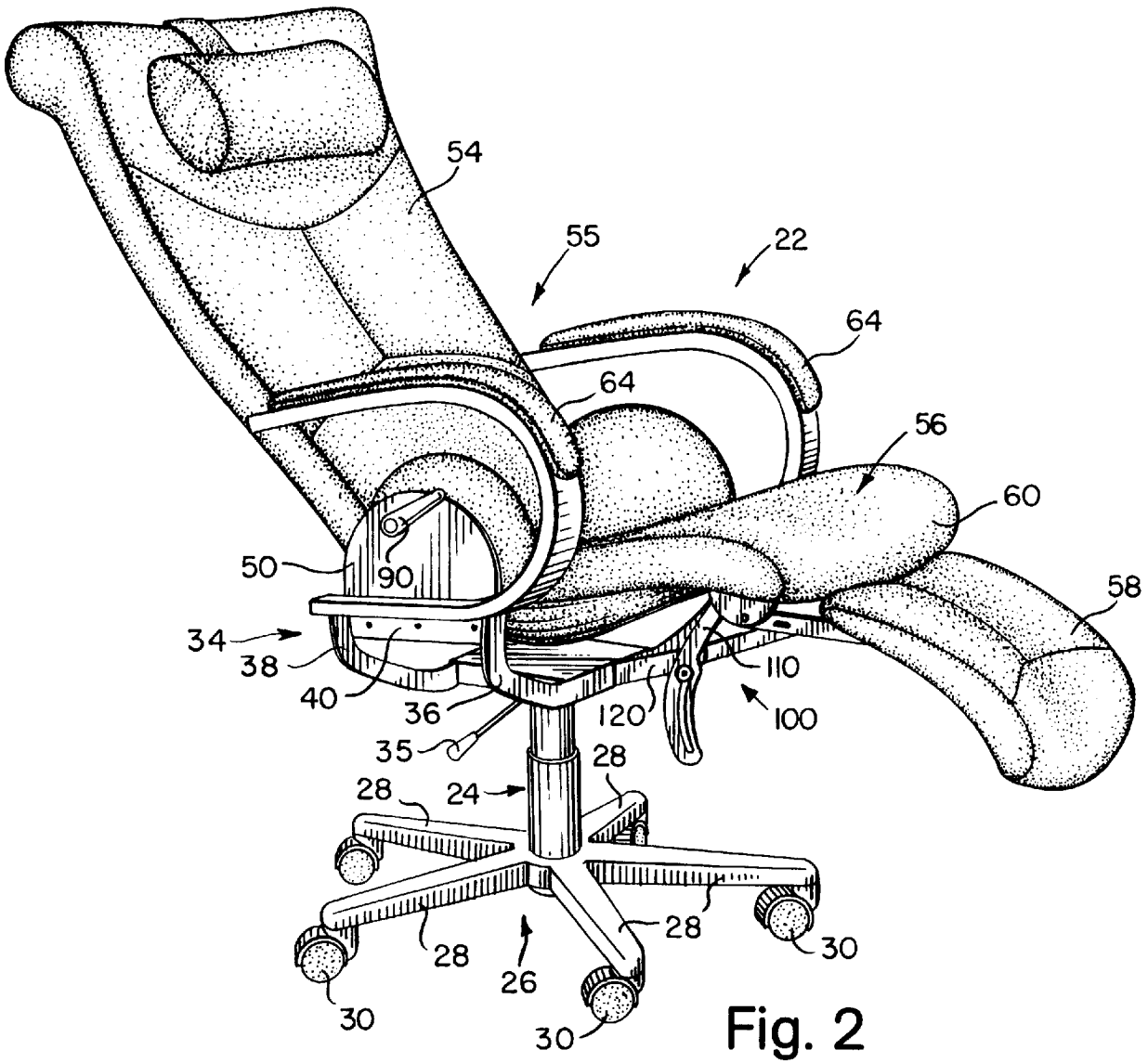
FIGS. 2 and 3 are perspective views of the chair shown in FIG. 1 and illustrated in the partially recline (or intermediate) and fully reclined positions, respectively.
Figure 3:
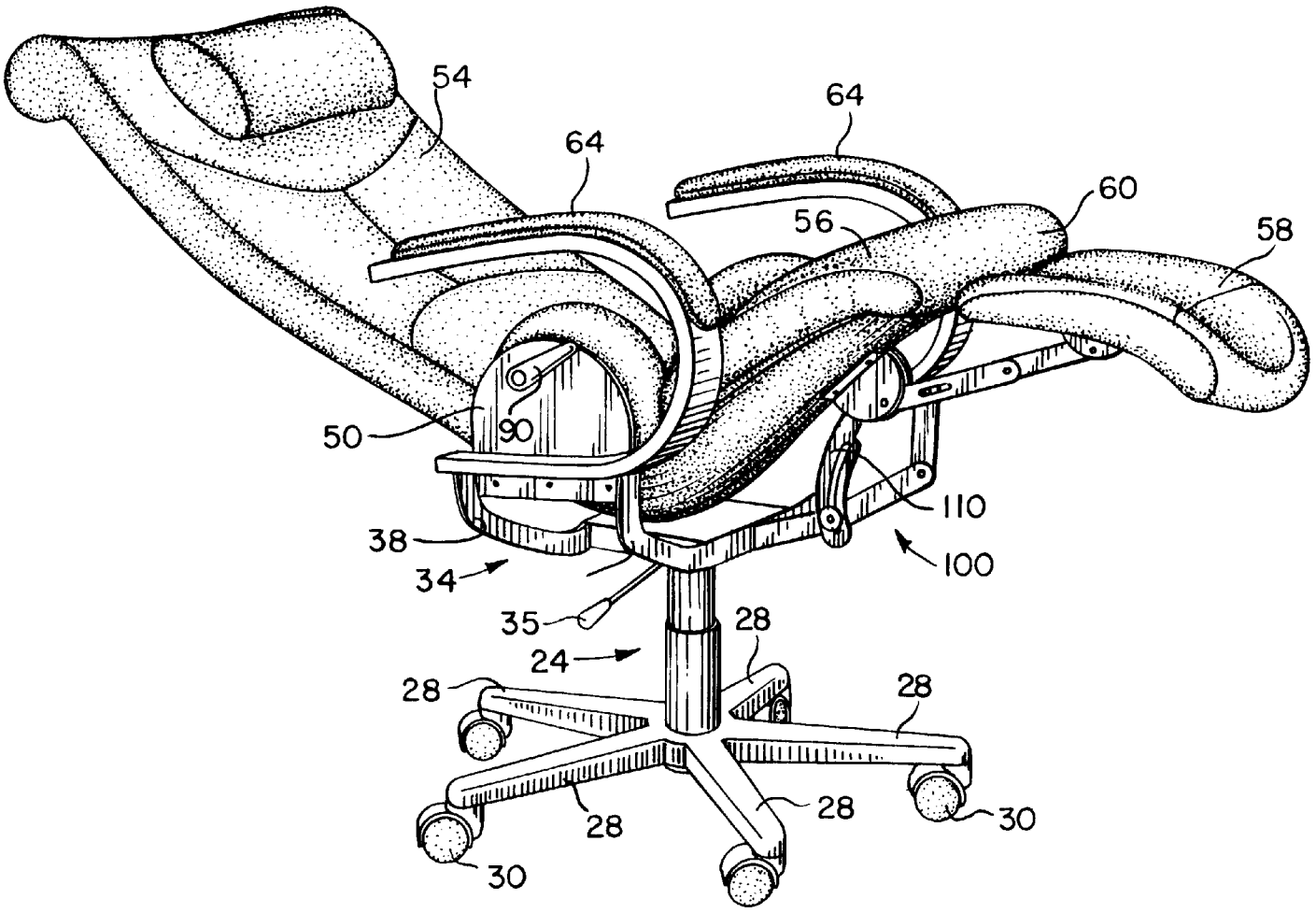
Figure 4:
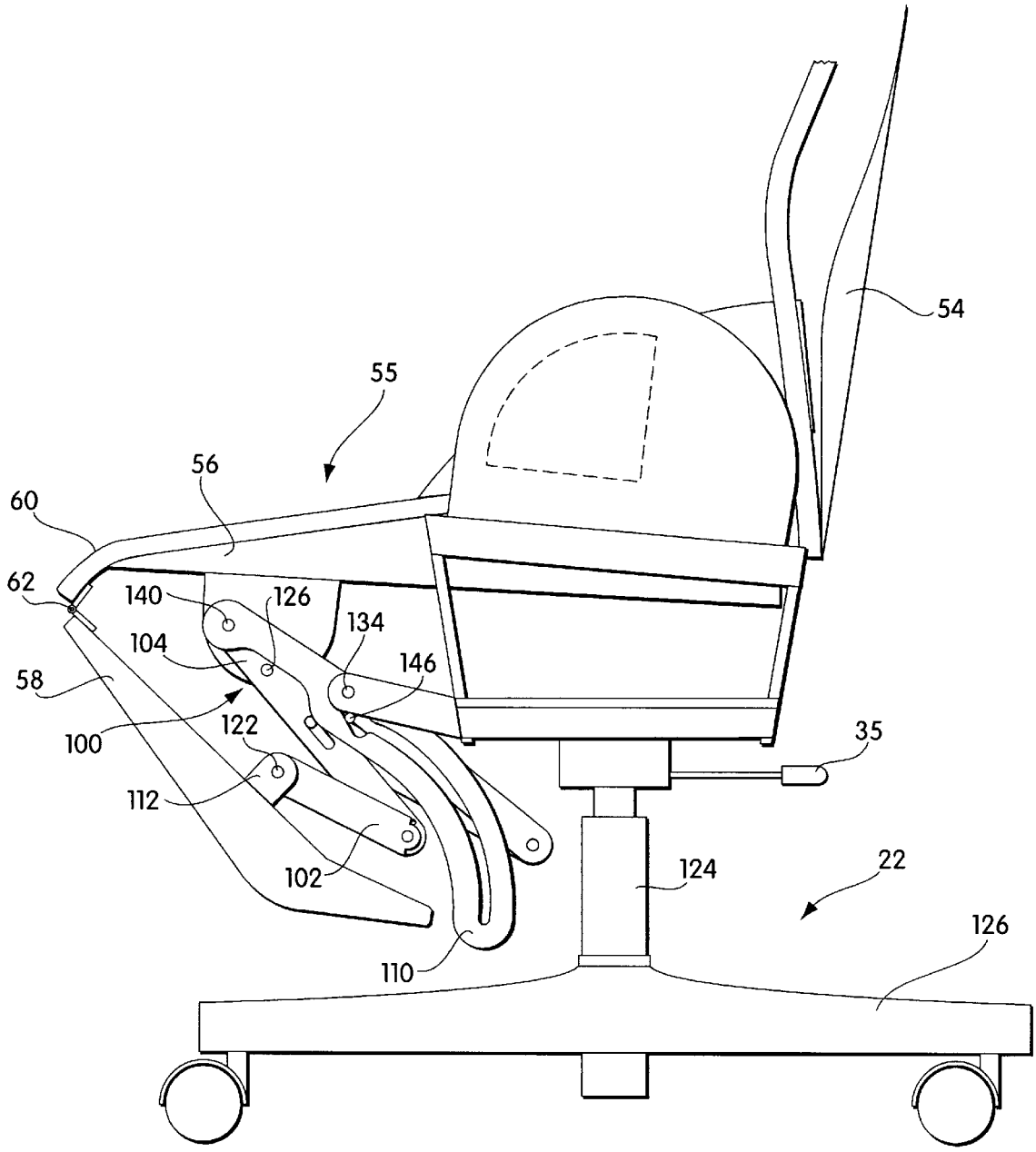
Figure 5:
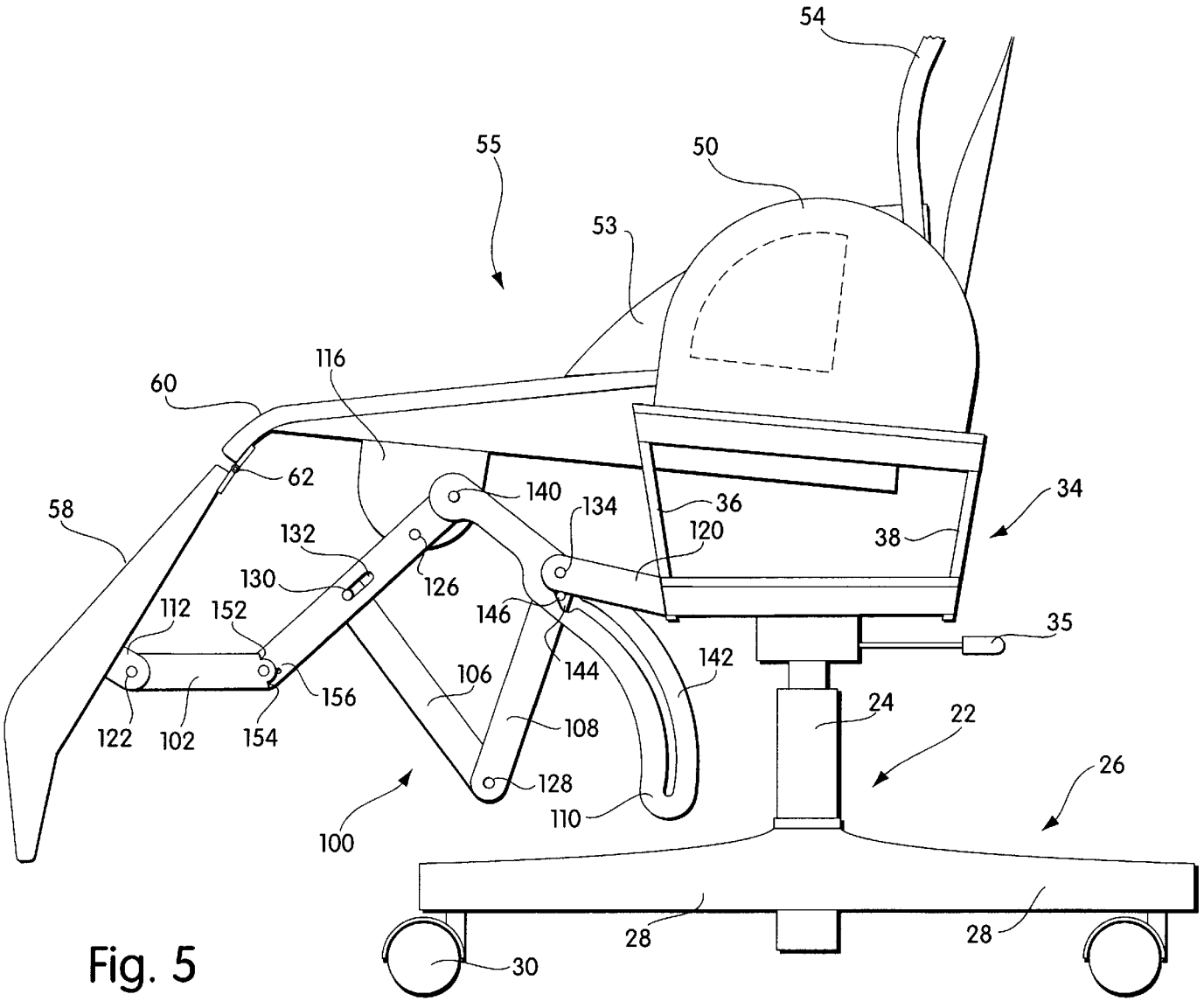
Figure 6:
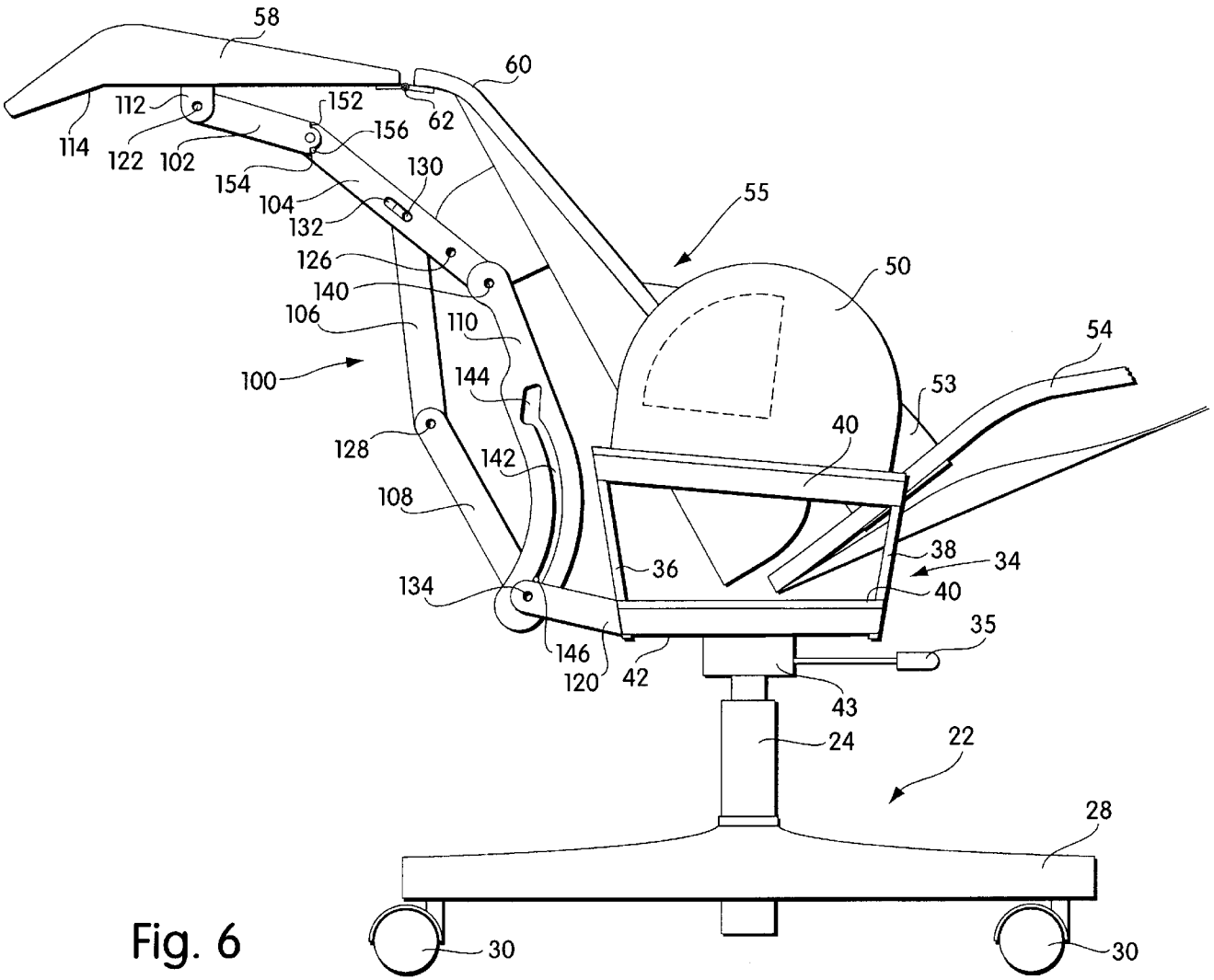
Figure 7:
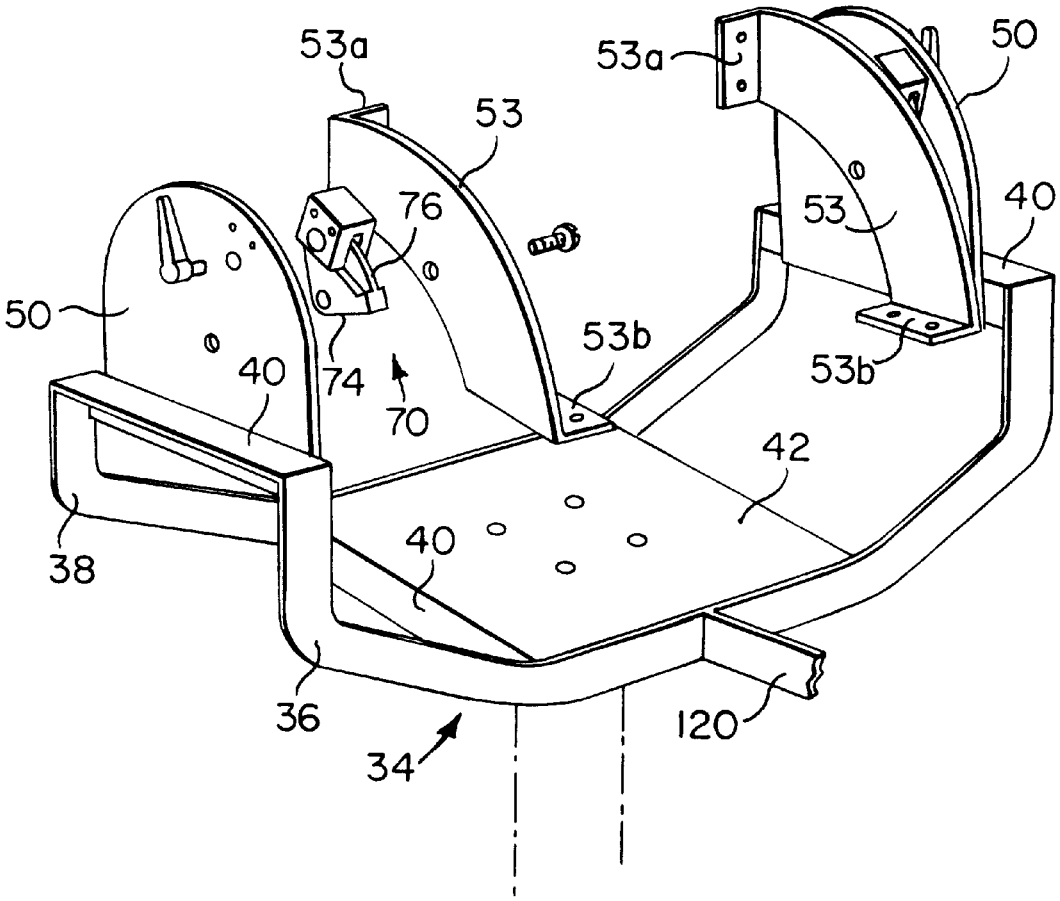
Figure 10:
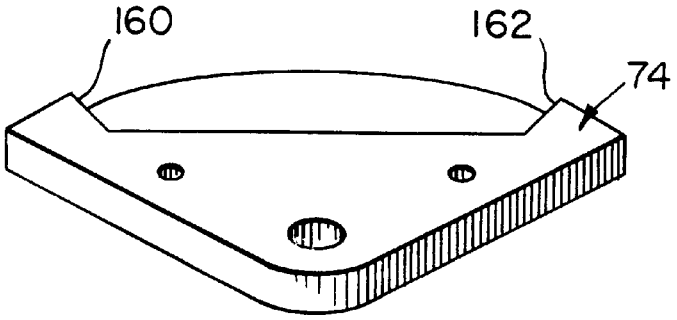
Figure 8:
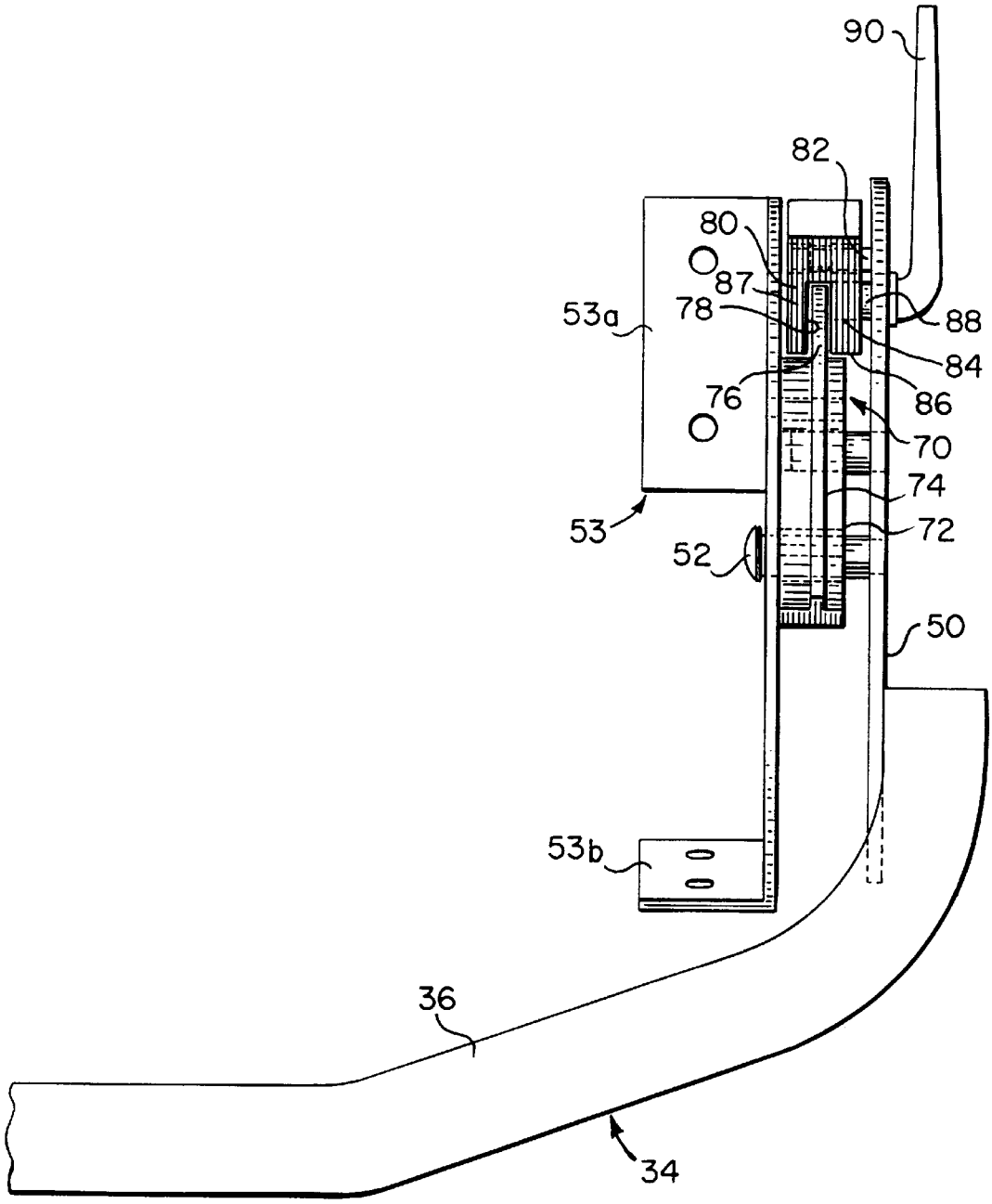
Figure 9:
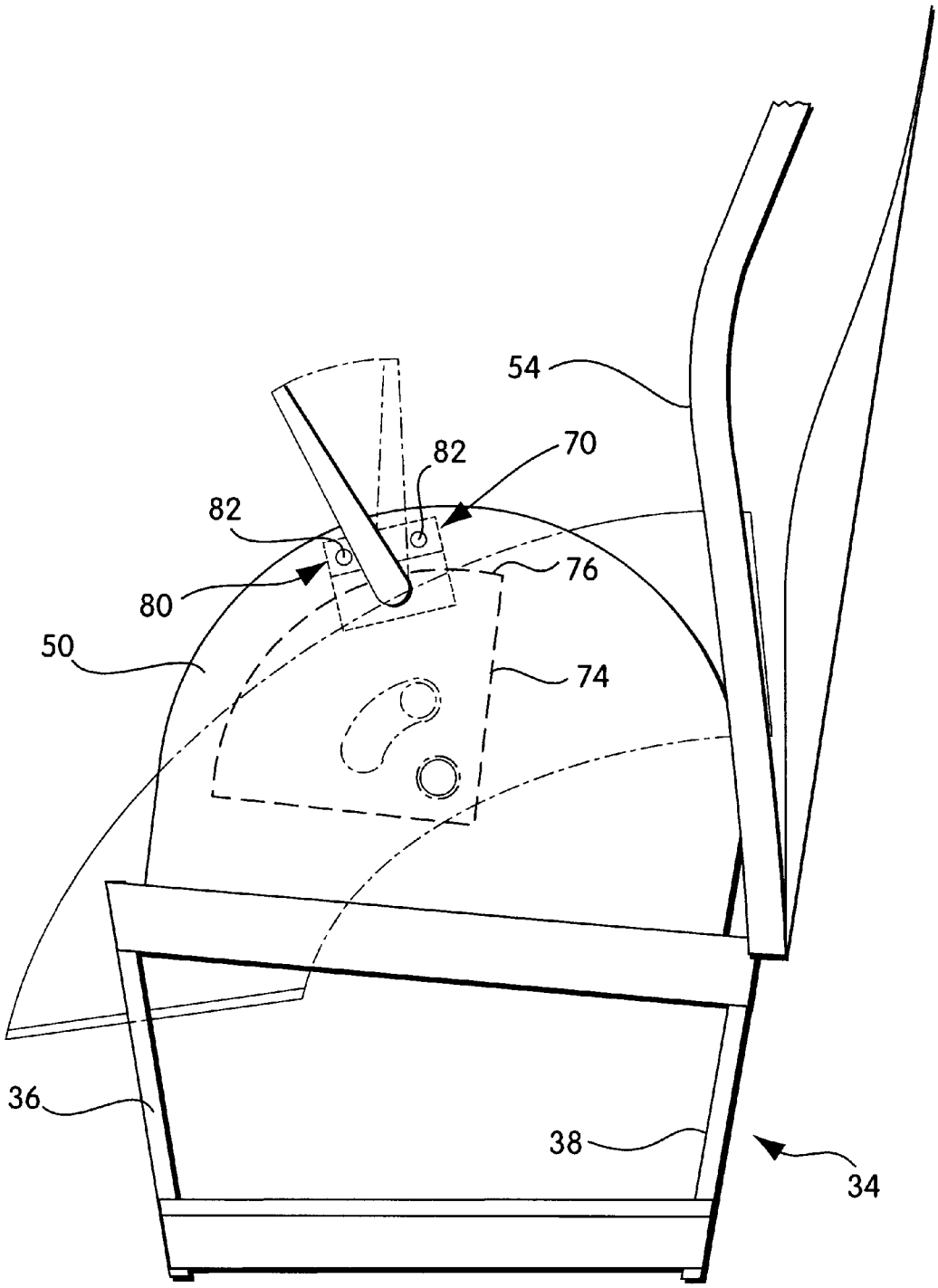

FIGS. 4, 5, and 6 are diagrammatic, fragmentary side views of the chair of FIGS. 1–3 and showing the footrest elevating mechanism in its upright, intermediate and fully reclined positions, respectively;

FIG. 7 is a fragmentary exploded perspective view of the brake assembly and bracket that carries the seat and backrest assembly in the chair of FIGS. 1–6;

FIG. 8 is a fragmentary front elevation view of the brake assembly and bracket shown in FIG. 7;

FIG. 9 is a fragmentary, diagrammatic side view of the brake assembly shown in FIGS. 7 and 8; and FIG. 10 is a perspective view of the brake disk.

DETAILED DESCRIPTION

The recliner executive desk chair invention shown in the drawings is embodied in a pedestal-swivel-type chair 22 having a pedestal which includes a height adjustable center post 24 carried on a base 26 having a plurality of radial feet 28 each bearing a caster 30. The top of the post 24 carries a broad U-shaped frame 34 that extends from one side of the chair to the other. The pedestal height adjustment mechanism (not shown) is controlled by a handle 35.

The U-shaped frame 34 includes essentially parallel front and rear members 36 and 38 that are connected together by several essentially horizontal braces 40 disposed at the top and bottom of the frame 34. A horizontal plate 42 also joins the front and rear member 36 and 38, and it carries a coupling 43 that joins the frame 34 to the top of the post 24.

A brake cover plate 50 is secured on each side of the frame 34 attached to the upper horizontal brace 40 as is evidence in FIGS. 4–7. The cover plates 50 that are made of heavy gauge sheet steel or material of comparable strength, carry coaxial axles 52 which in turn pivotally support brackets 53 that are part of the body support assembly 55 of the chair. The assembly 55 includes a back 54, seat 56 and footrest 58. The brackets 53 form the base of the body support assembly 55 and are arcuate in shape as shown in FIG. 7. The brackets have mounting plates 53*a* and 53*b* that establish a fixed angular relationship between the back 54 and seat 56 to which they are connected, in all positions of the body support 55. The footrest 58 on the other hand is pivotally connected to the front edge 60 of the seat 56 by hinges 62 so that the angular relationship between the seat 56 and foot rest 58 may be varied in response to tilting of the body support assembly 55 on the axles 52. Armrests 64 are provided on each side of the frame 34 as shown in FIGS. 1–3 and remain fixed as the body support 55 pivots on the axles 52.

FIGS. 7–9 show the brake assembly 70 that locks the body support 55 in any selected angular position on the axles 52. While the brake assembly 70 on but one side of the chair frame 34 is illustrated and described, duplicate assemblies which are mirror images of each other preferably are provided on both sides of the chair. In the illustrated embodiment, the bracket 53 which pivots on the axle 52 is carried by a bushing 72 that also carries a brake disk 74. Thus, the brake disk 74 pivots with the bracket 53 on axle 52 as the position of the body support 55 is changed at the will of the chair occupant. The disk brake 74 is pie-shaped, and its arcuate edge 76 moves in a vertical slot 78 in a brake block 80 that floats horizontally on a pair of pins 82 secured to the brake cover plate 50. The brake block 80 which is generally U-shaped has a threaded hole 84 in its outer leg 86 that receives a stud 88 connected to the brake handle 90. The stud is rotatably supported on the cover plate 50 but is free to move axially on the plate. Simply by turning the stud 88 by means of the handle, the brake block 80 will be moved so as to cause its inner leg 87 to bear against the disk 74 and the end of the stud 88 to engage the opposite face of the brake disk and prevent the body support assembly 55 from moving with respect to the frame 34. By turning the stud in the opposite direction by means of handle 90, the brake block and stud may be made to release the brake disk so as to allow the body support 55 to pivot freely on the axles 52.

It should be noted in the drawings that both the adjustable brake block 80 and the bushing 72 which carries the brake disk 74 float freely on the support pins 82 and axle 52, respectively. This feature provides a substantial tolerance for body supports of different widths which may be carried within the U-shaped frame 34. While the frame 34 may be made to close tolerances as it is normally made of steel, the body support 55 may include a plywood back and upholstered cushions and therefore vary substantially from one unit to another, and the U-shaped frame must be able to accommodate those variable dimensions if the chair is to be capable of being mass produced and priced within a reasonable range.

While in the illustrated embodiment, the handle 90 is shown to control the position of the stud 88 which in turn adjusts the break block 80, it will be appreciated that a knob-shaped handle on the stud may replace handle 90 and it may be conveniently engaged by the chair occupant to lock and unlock the body support in an infinite variety of angular positions.

In FIG. 4–6, the linkage mechanism 100 for automatically elevating and retracting the foot rest 58 in response to pivotal motion of the body support assembly 55 on the axles 52 is shown in detail. It should be noted that when the chair is in the upright position of FIGS. 1 and 4, the footrest 58 is fully retracted out of the way beneath the seat 56, and will not in any way interfere with the feet of the chair occupant as he/she enters or leaves the chair nor will it inhibit the occupant from placing his/her feet flat on the floor beneath the front of the seat. The footrest 58 remains elevated in its operative position and forms a continuation of the seat 56 when the chair is partially or fully reclined. The mechanism 100 is connected to the seat 56, footrest 58 and the frame 34 and is disposed intermediate the sides of the chair. The mechanism is composed of five separate links 102, 104, 106, 108, and 110, and is connected to bracket 112 fixed to the bottom 114 of the footrest 58, to the bracket 116 on the bottom 118 of seat 56 and to the bracket 120 fixed to and extending forwardly from the front of the frame 34. The mechanism 100 is most clearly shown in FIG. 6 wherein the chair is shown in the fully reclined position. As seen in that figure, one end of the link 102 is pivotally connected by pivot 122 to the bracket 112 on the bottom of the footrest 58, and the other end of link 102 is pivotally connected by pivot 124 to one end of link 104. Links 102 and 104 form a scissors linkage and together comprise an over center lock for supporting the footrest in the fully extended position. This action is described in greater detail below. A pivot 126 connects the other end of link 104 to the bracket 116 fixed to and movable with the seat 56.

The links 106 and 108 are pivotally connected together at their adjacent respective ends by a pivot 128 while the other end of link 106 is connected by means of pivot pin 130 in a slot 132 in the mid-portion of link 104. The opposite end of link 108 is connected by means of a fixed pivot 134 to the forward end of the bracket 120 on the frame 34.

Link 110 is pivotally connected at its upper end as shown in FIGS. 5 and 6 by pin 140 to the free end of link 104 on the far side of pivot 126 which connects the link 104 to bracket 116. The other end of link 110 is not connected at a fixed point to other links but rather is provided with a long arcuate slot 142 which is enlarged as shown at 144 in the mid-portion of link 110. The fixed pivot 134 on the bracket 120 extends into slot 142 and slides along the length of the slot when the footrest is moved between the extreme positions shown in FIGS. 4 and 6. Link 108 adjacent its pivot 134 carries a pin 146 also disposed in slot 142.

When the body support assembly 55 is in the upright position shown in FIG. 4, the scissors linkage composed of link 102 and 104 is folded about the pivot 124 so that the two links substantially overlie one another. Similarly, the links 106 and 108 that comprise a second scissors linkage are folded upon one another about the pivot 128 so that the two links are substantially superimposed. In that position of the chair, control link 110 is almost horizontal with the pivot 134 and pin 146 disposed in the enlarged end 144 of slot 142.

As the body support assembly 55 begins to pivot rearwardly about the axle 52, the relative positions of the seat 56 and footrest 58 remain fixed while the control link 110 turns clockwise slightly causing the pivot 134 and pin 146 to move toward the lower end of the enlarged portion 144 of the slot 142. Ultimately, the pivot 134 engages the shoulder 150 in the enlarged portion 144 of the slot, and prevents the link 110 from being pulled further upwardly with the seat 56. Consequently the control link 110 pivots clockwise about the pin 146 which in turn causes the link 104 to pivot clockwise on pivot 126. That action in turn causes the link 102 to push upwardly on the bracket 112 on the bottom of the footrest so as to begin the extension of the footrest from its tucked position underneath the seat toward its fully extended position. Continued rearward tilting motion of the body support assembly 55 causes the links 102 and 104 to become aligned with one another on pivot 124 which joins the two, and ultimately that pivot 124 passes over center so as to lock the footrest in its fully extended position with respect to the seat as shown in FIG. 6. It will be noted that stops 152 and 154 are provided on the end of link 102 at a fixed radius from the pivot 124. A pin 156 carried at the end of link 104 is positioned to engage the two stops so as to limit the over center travel in (both directions) of the scissors linkage made up of the links 102 and 104. Note in FIGS. 4 and 6 the pin 156 engaging the separate stops. In the embodiment shown, full extension of the footrest is achieved when the body support assembly pivots rearwardly approximately 20–25° from the upright position. During the initial reclining motion of approximately 10°, the footrest does not move with respect to the seat. Further reclining motion of the body support 55 to the fully reclined position of FIGS. 3 and 6 causes the control link 110 to be drawn upwardly by the link 104 as the pin 146 becomes aligned with the main portion of the slot 142, and both the pin 146 and pivot 134 move down the slot. The reclining motion of the body support is limited by the stop 160 (see 10) formed in the periphery of the brake disk 74 as it is engaged by the stud 88. The upright position of the seat is also established by a second stop 162 formed in the periphery of the brake disk 74. In the fully reclined position shown in FIG. 6, both scissors linkages made up of links 102 and 104, and 106 and 108, are essentially in the fully opened position and the pin 130 on the end of link 106 has moved to the lower end of the slot 132 in link 104.

As the chair begins its return to the upright position from the fully reclined position, the footrest 58 remains in the extended position as the pivot 134 and pin 146 travel upwardly in the slot 142 toward the enlarged upper end 144. The links 106 and 108, however, begin to fold about the pivot pin 128, but the links 102 and 104 remain in their over center, locked position shown in FIG. 6 so as to support the footrest 58 in the elevated position until the pivot 134 on the bracket 120 and the pin 146 reach the top of the curved portion of the slot 142. Continued motion of the body support assembly 55 carries the pivot 134 and pin 146 to the top of the enlarged end 144 of the slot 142, which then causes the control link 110 to pivot the link 104 in a counterclockwise direction about pivot 126 which in turn causes the links 102 and 104 to pass over center and begin to fold upon one another. As the links 102 and 104 pass over center, the footrest 58 begins to pivot on its hinge 62 relative to the seat 56 toward its stored position tucked underneath the seat. At the same time, the pivot pin 130 disposed in the slot 132 in link 104 slides toward the opposite end thereof. Continued rotation of the body support to the fully upright position causes the footrest to fully retract beneath the seat 58 to the stored or inoperative position shown in FIGS. 1–4.

From the foregoing description, it will be appreciated that the chair of the present invention provides an infinite variety of positions between upright and fully reclined as the assembly 55 pivots about the axles 52. In the fully reclined position, the chair cradles the body from head to foot for maximum relaxation. The footrest is disposed in a substantially horizontal plane with the occupant's legs above the heart to promote circulation and relieve muscle tension. When the chair is brought to the upright position, the footrest is tucked out of the way beneath the seat so as not to interfere with access to or egress from the chair. The mechanism operates automatically to retract the footrest when the chair is brought to the upright position. Furthermore, the chair can be locked in any desired position by the occupant by means of the brake mechanisms 70 on each side of the chair.

Because of the retractability of the footrest, the chair not only functions effectively as a recliner but also enables the chair to be used as an executive high back desk chair with all of the conveniences of an office swivel chair. In summary, it may be used effectively as an ergonomically supportive upright desk chair as shown in FIG. 1, as a semi-recliner for relaxed phone conversations or reading as in FIG. 2, or as a full recliner for an invigorating break during a hectic workday.

Having described this invention in detail, those skilled in the art will appreciate that numerous modifications may be made thereof without departing from the spirit of the invention.

Therefore, it is not intended that the breadth of the invention be limited to the single embodiment illustrated and described. Rather, the invention is to be interpreted by the breadth of the appended claims and their equivalents.

What is claimed:

1. A reclining chair comprising a pedestal-type-swivel base having a U-shaped frame supported on a vertical post, said frame having upwardly extending and spaced apart sides, a pair of coaxial axles extending horizontally one from each side of the frame and each axle carrying a bracket, said brackets being pivotally supported for movement about the axes of the axles, a seat and back mounted as an assembly on the brackets with the seat and back in fixed relationship to one another and pivotal with the brackets between upright and reclined positions, a brake mechanism have a first brake element mounted on at least one of the axles and movable with the bracket as the bracket pivots with the seat and back assembly about the axes of the axles as the assembly moves between upright and reclined positions, a second brake element connected to the side of the frame and positioned to engage and disengage the first brake element to selectively prevent and permit pivotal movement of the brackets and seat and back assembly about the axes of the axles, and an actuator connected to the brake mechanism for operating the brake mechanism.

2. A reclining chair as defined in claim 1 wherein a footrest is connected to the seat and back assembly.

3. A reclining chair as defined in claim 2 wherein the footrest is pivotally mounted on the seat.

4. A chair as defined in claim 1 wherein the brackets are axially slidable on the axles independently of one another so as to accommodate seat and back assemblies of different widths.

5. A reclining chair comprising a base and a body support assembly pivotally mounted for rocking movement between upright and reclined positions about a fixed horizontal axis on the base, said body support assembly having a seat and back which remain in fixed relationship to one another during said rocking movement, means joining the body support assembly on the base enabling the assembly to move axially with respect to the fixed horizontal axis on the base, a brake mechanism connected to the base and body support assembly, said brake mechanism including a first brake member mounted on and movable pivotally and axially with the body support assembly on the base and a second brake member mounted on the base, and an actuator connected to the brake mechanism for selectively causing the second brake member to engage and disengage the first brake member to prevent and permit rocking motion of the body support assembly about the axis between upright and reclined positions.

6. A reclining chair as defined in claim 5 wherein a footrest is connected to the body support assembly.

7. A chair as defined in claim 5 wherein a footrest is pivotally connected to the seat, and a mechanism is connected to the footrest for moving it between elevated and stored positions as the body support assembly moves between reclined and upright positions.

8. A chair as defined in claim 7 wherein the footrest in the stored position is tucked under the seat so as not to interfere with an occupant of the chair placing his/her feet beneath the front of the seat when the chair is upright.

9. A reclining chair comprising a base and a body support assembly pivotally mounted for rocking movement between upright and reclined positions about a fixed horizontal axis on the base, said body support assembly having a seat and back means joining the body support assembly on the base enabling the assembly to move axially with respect to the fixed horizontal axis on the base, a brake mechanism connected to the base and body support assembly, said brake mechanism including a first brake member fixed to and movable pivotally and axially with the body support assembly on the base and a second brake member mounted on the base, said second brake member being movable parallel to the pivotal axis on the base, and an actuator connected to the brake mechanism for selectively causing the second brake member to engage and disengage the first brake member to prevent and permit rocking motion of the body support assembly about the axis between upright and reclined positions.

10. A reclining chair comprising a base and a body support assembly pivotally mounted for rocking movement between upright and reclined positions about a fixed horizontal axis on the base, said body support assembly having a seat and back, means joining the body support assembly on the base enabling the assembly to move axially with respect to the fixed horizontal axis on the base, a brake mechanism connected to the base and body support assembly, said brake mechanism including a first brake member mounted on and movable pivotally and axially with the body support assembly on the base and a second brake member mounted on the base, and an actuator connected to the brake mechanism for selectively causing the second brake member to engage and disengage the first brake member to prevent and permit rocking motion of the body support assembly about the axis between upright and reclined positions.

11. A reclining chair comprising a pedestal-type-swivel base having a U-shaped frame supported on a vertical post, said frame having upwardly extending and spaced apart sides, a pair of coaxial axles extending horizontally one from each side of the frame and each axle carrying a bracket, said brackets being pivotally supported for movement about the axes of the axles, a seat and back mounted as an assembly on the brackets and pivotal with the brackets between upright and reclined positions, a brake mechanism have a first brake element mounted on at least one of the axles and movable with the bracket as the bracket pivots with the seat and back assembly about the axes of the axles as the assembly moves between upright and reclined positions, a second brake element connected to the side of the frame and positioned to engage and disengage the first brake element to selectively prevent and permit pivotal movement of the brackets and seat and back assembly about the axes of the axles, and an actuator connected to the brake mechanism for operating the brake mechanism.

12. A reclining chair as defined in claim 11 wherein a footrest is connected to the seat and back assembly.

13. A reclining chair as defined in claim 12 wherein the footrest is pivotally mounted on the seat.

14. A reclining chair comprising a base and a body support assembly pivotally mounted for rocking movement between upright and reclined positions about a fixed horizontal axis on the base, said body support assembly having a seat and back, a brake mechanism connected to the base for releasably locking the body support assembly in selected positions between the upright and reclined positions, said brake mechanism including a brake disk connected to and pivotal with the body support assembly on the base, a brake block mounted on the base and having a friction surface positioned to engage the brake disk, and an actuator mounted on the base and connected to the block for moving the friction surface in and out of contact with the disk to lock and release the body support assembly for pivotal movement about the axis, a footrest pivotally connected to the seat and movable between a stored position wherein it is disposed under the seat inwardly of the front edge of the seat when the body support assembly is in the upright position and an extended position wherein it is disposed in a substantially horizontal position extending forwardly from the front edge of the seat when the body support assembly is in an extreme reclined position.

15. A chair as defined in claim 14 wherein a linkage mechanism is connected to the footrest for moving it between the stored and extended positions, said linkage mechanism including a first pair of folding links connected at one end to the footrest and at the other end to the body support assembly, a second pair of folding links connected at one end to the base and at the other end to one of the first pair of folding links, and a drive link connected to one of the first pair of folding links and slidably connected to the base for causing the first pair of folding links to open as the body support assembly moves toward the reclined position from the upright position for pushing the footrest to the extended position.

16. A chair as defined in claim 15 wherein the base is a swivel base with radially extending feet and casters.

17. A reclining chair comprising a base and a body support assembly pivotally mounted for rocking movement between upright and reclined positions about a fixed horizontal axis on the base, said body support assembly having a seat and back, means joining the body support assembly on the base enabling the sides of the assembly to move axially with respect to the fixed horizontal axis on the base, a brake mechanism connected to the base and body support assembly, said brake mechanism including a first brake member fixed to and movable pivotally and axially with the body support assembly on the base and a second brake member mounted on the base, and an actuator connected to the brake mechanism for selectively causing one of the brake members to engage and disengage the other brake member to prevent and permit rocking motion of the body support assembly about the axis between upright and reclined positions.

18. A chair as defined in claim 17 wherein a footrest is operatively connected to the seat, and a mechanism is connected to the footrest for moving it between elevated and stored positions as the body support assembly moves between reclined and upright positions.

19. A reclining chair comprising a base having a frame, said frame having upwardly extending and spaced apart sides, a pair of coaxial axles extending horizontally one from each side of the frame and each axle carrying a bracket, said brackets being pivotally supported for movement about the axes of the axles, a seat and back mounted as an assembly on the brackets with the seat and back pivotal with the brackets between upright and reclined positions, a brake mechanism have a first brake element mounted on at least one of the brackets and movable with the bracket as the bracket pivots with the seat and back assembly about the axes of the axles as the assembly moves between upright and reclined positions, a second brake element connected to the side of the frame and positioned to engage and disengage the first brake element to selectively prevent and permit pivotal movement of the brackets and seat and back assembly about the axes of the axles, and an actuator connected to the brake mechanism for operating the brake mechanism.

20. A chair as defined in claim 19 wherein the frame includes a shield outside each of the brackets for covering the brake mechanism.

21. A chair as defined in claim 19 wherein the brackets are axially slidable on the axles independently of one another so as to accommodate seat and back assemblies of different widths.

22. A chair as defined in claim 21 wherein the first brake element is rigidly connected to and moves with the brackets on the axles.

* * * * *